US006224057B1

(12) United States Patent
Morton

(10) Patent No.: US 6,224,057 B1
(45) Date of Patent: May 1, 2001

(54) ENHANCED WORD GAME METHOD

(76) Inventor: Randall A. Morton, 29881 Weatherwood, Laguna Niguel, CA (US) 92677

( * ) Notice: Subject to any disclaimer, the term of this patent is extended or adjusted under 35 U.S.C. 154(b) by 0 days.

(21) Appl. No.: 09/224,346

(22) Filed: Dec. 13, 1998

(51) Int. Cl.[7] ..... A63F 3/00
(52) U.S. Cl. ..... 273/272; 273/430; 273/431
(58) Field of Search ..... 273/243, 272, 273/429, 430, 431

(56) References Cited

U.S. PATENT DOCUMENTS 4,350,342 * 9/1982 Barulich .
4,884,815 * 12/1989 Glenn .
5,066,016 * 11/1991 O'Neill .
5,067,721 * 11/1991 Hart .
5,112,057 * 5/1992 Popovic .
5,121,928 * 6/1992 Salerno-Sonneberg .
5,645,280 * 7/1997 Zelmer .

* cited by examiner

*Primary Examiner*—William M. Pierce

(57) ABSTRACT

The present invention is a game which merges two previous game formats into a unique and novel game comprising a game board and playing pieces for each player to mark the movement of the players as the players advance around the game board. During each turn, the player must answer a question and construct a list of words based upon the letters in the correct answer. The player accumulating a predetermined number of points is declared the winner.

5 Claims, 5 Drawing Sheets

MISH MASH
PRESIDENTS
HISTORY
MISH MASH
HISTORY
PRESIDENTS
HISTORY
PRESIDENTS
HISTORY
MISH MASH
HISTORY
PRESIDENTS
HISTORY
MISH MASH
HISTORY
PRESIDENTS
HISTORY
MISH MASH

START
MISH MASH
PRESIDENTS
HISTORY
MISH MASH
PRESIDENTS
HISTORY
MISH MASH
PRESIDENTS
HISTORY

HISTORY

Q: Will Rogers came from this state?

A: Oklahoma - Possible words: Ham; lamb; alamo; loom.

PRESIDENTS

Q: This U.S. President was known as quiet Calvin? Last name only.

A: Coolidge - Possible words: Cool; dog; led; cod; lid; ledg.

MISH MASH

Q: A body of water that flows into a larger body of water is called what?

A: Tributary - Possible words: But; tar; rib; rub; tab; rat; bar.

FIG. 2

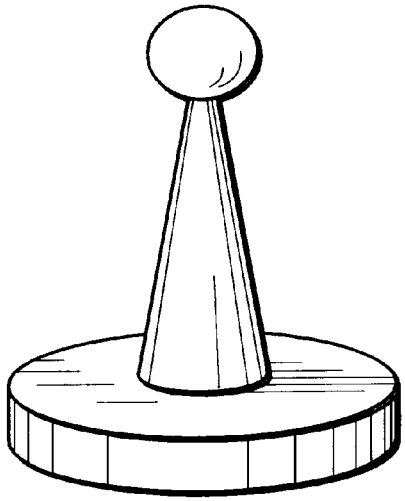
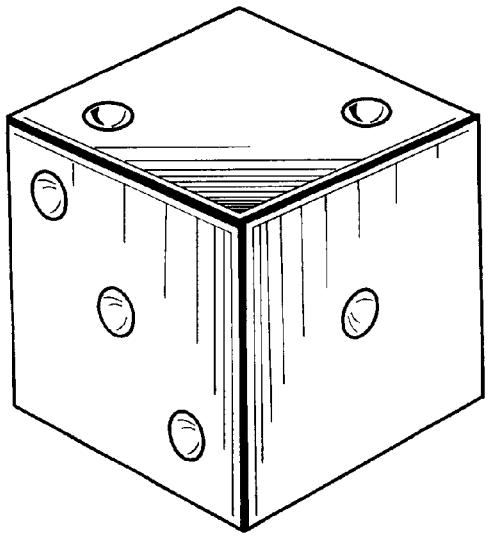
FIG. 3

ENHANCED WORD GAME METHOD

I. BACKGROUND AND FIELD OF THE INVENTION

There have been numerous board games developed and played through the ages, including such games as chess, checkers, Parcheesi and Monopoly. These games have been limited to the movement of playing pieces within a fixed playing framework controlled either by the rules of the game. Such a game is chess where the game is played on an 8×8 playing matrix, but each pieces can only move within this matrix based upon rules of movement assigned to each piece. A second type of game is where the playing field is a series of fixed locations on the game board, such as Monopoly. In Monopoly, the playing field is a set of locations located only along the periphery of the game board. Each playing piece is allowed to occupy any space on the board. The actual location is controlled only by the number of spaces that each piece advances along the periphery of the game board, from the start position. The number of spaces that the player advances is controlled by a random number generator such as the throw of dice.

There has also been developed a separate and distinct line games which are based upon words and letters of the English language. Generally, these games are based upon either forming words from a collection of letters, such as Scrabble or Boggle, or deducing a whole word or phrase when some portion of the letters making up the word or phrase are known, such the popular Wheel of Fortune. There has been no game developed which combines together these two popular game formats.

II. SUMMARY OF THE INVENTION

The game is played by assigning a token or marker to each player and placing the marker on the start square of the game board. The game board consists of a series of squares located around the periphery of the board. Each square contains the name of a subject which corresponds to a series of questions cards pertaining to that subject. As the player advances his marker around the board based upon the number showing from the throw of a die. On each turn, a question card is taken from the stack of cards that correspond to the subject indicated on space on the game board on which the player landed. The question contained on that card is presented to the current player by one of the other persons playing the game. If the current player answers the question correctly, then that player has an additional 60 seconds to construct as many other words as possible using the letters that made up the correct answer. Each newly constructed word must contain at least 3 letters. The current player receives a fixed number of points for answering the question correctly and a fixed number of points for each valid newly constructed word that the player made.

III. BRIEF DESCRIPTION OF THE DRAWINGS

FIG. 2 shows examples of question cards used in the instant game.

FIG. 3 shows one possible embodiment of a marker and a die which is the preferred embodiment of the random number generator.

IV. DESCRIPTION OF THE PREFERRED EMBODIMENT

Figure 1:
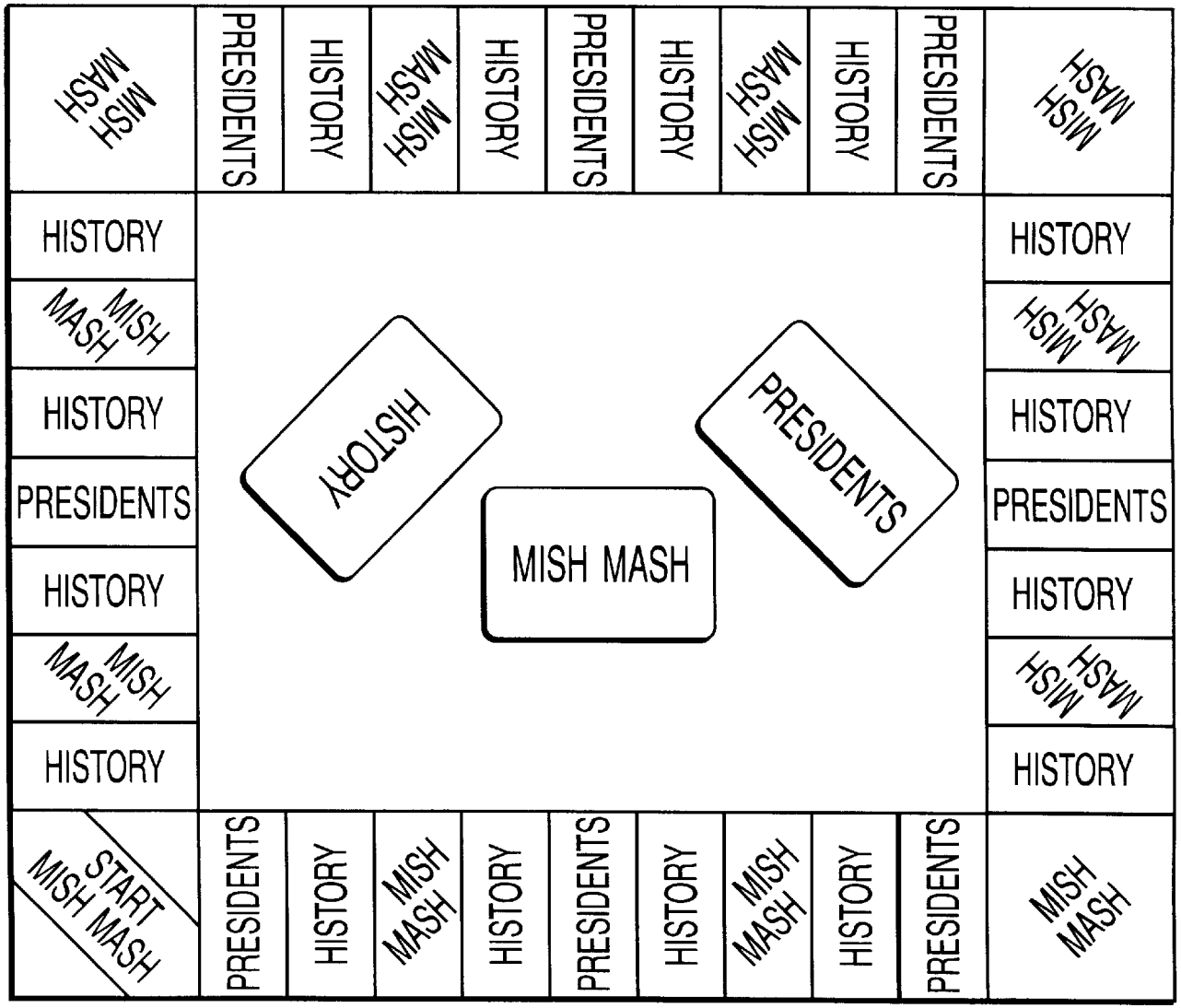
FIG. 1 shows the preferred embodiment of the game board.
Figure 4A:
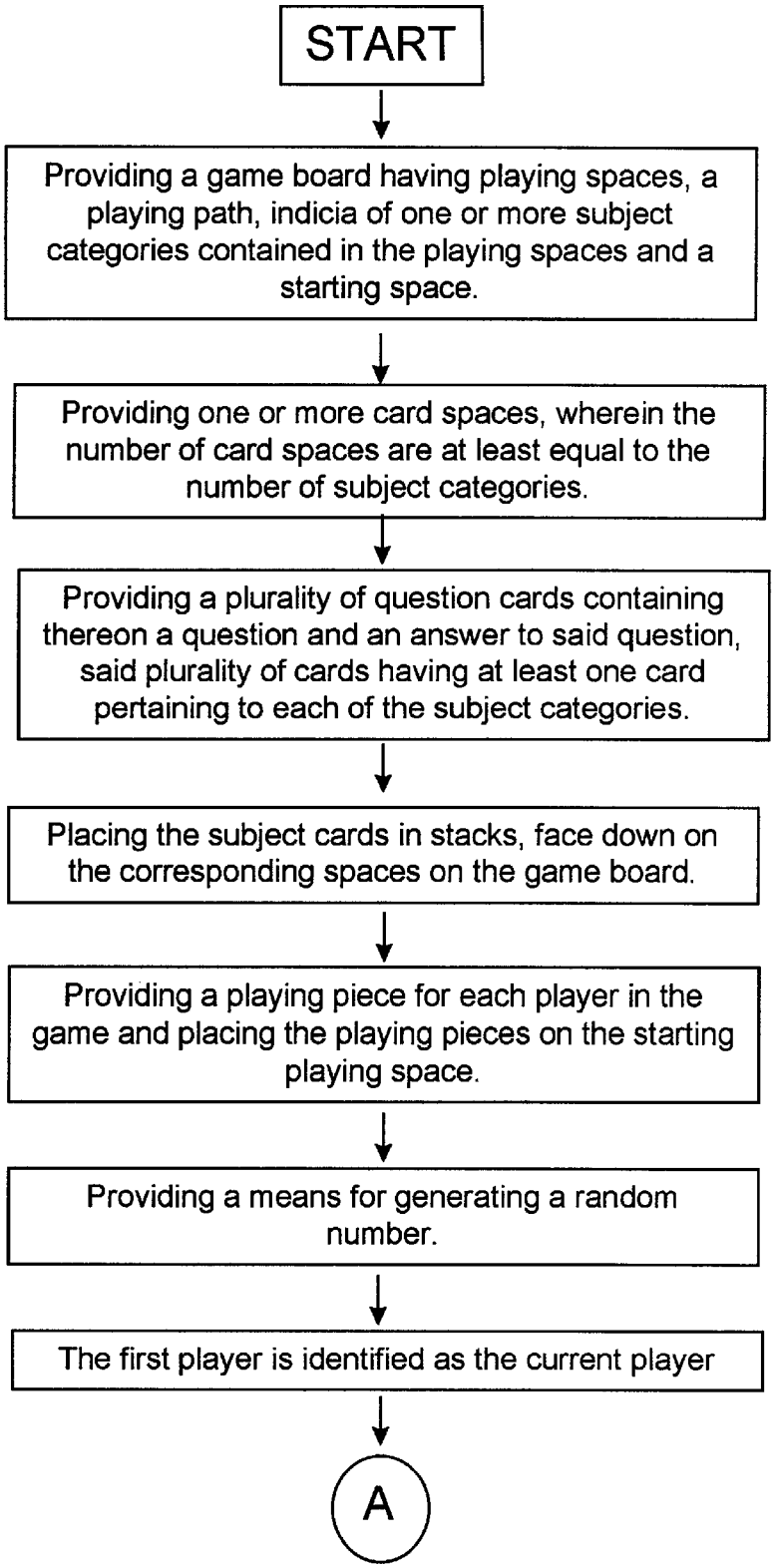
FIGS. 4A and 4B is a flow chart showing the method of playing Applicant's game.
Figure 4B:
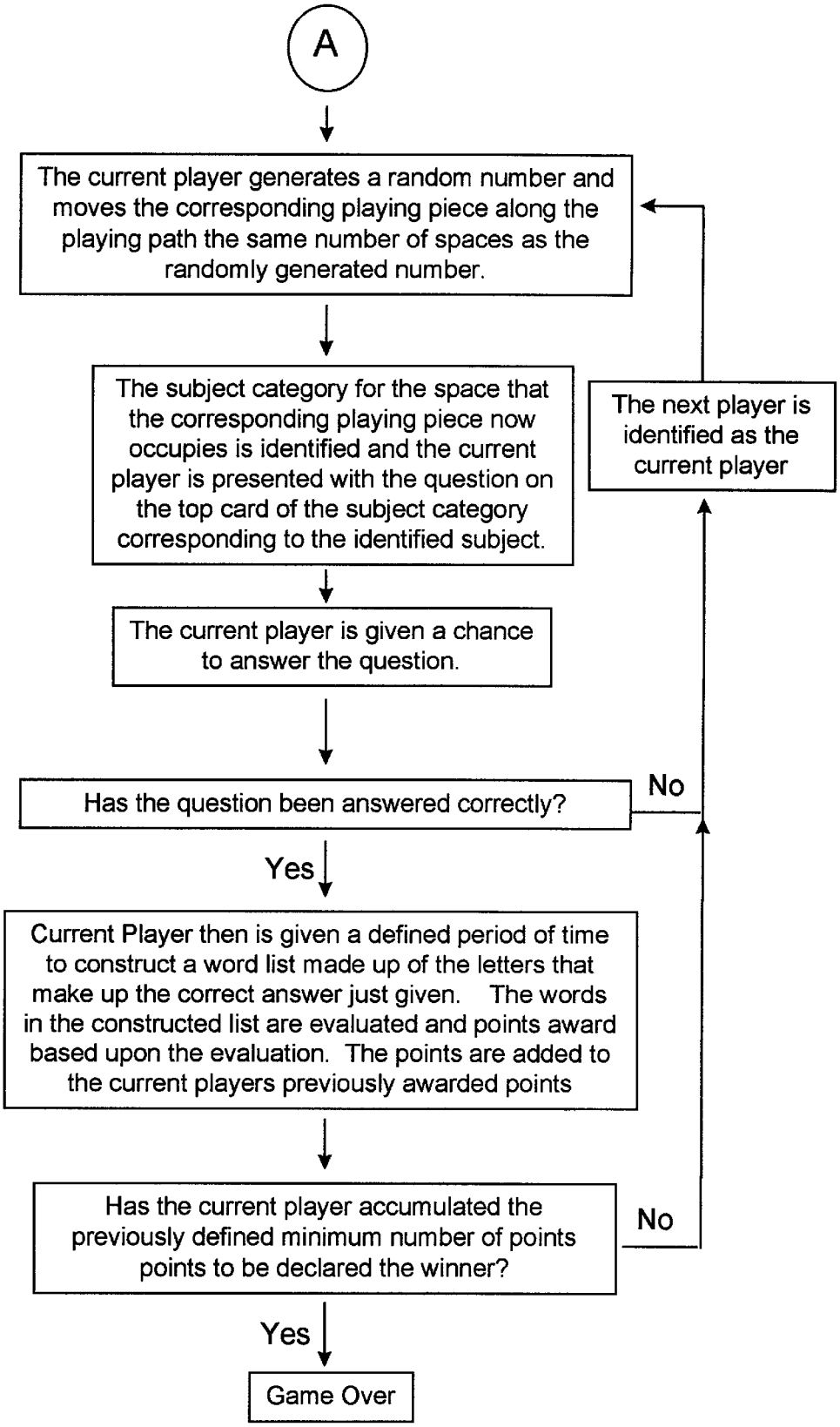

The preferred game board is shown in FIG. 1. The board consists of a series of squares located along the periphery of the rectangular game board. Each player chooses a token or marker. At the start of the game all the markers are placed on the START square. This square, shown in the lower left comer of FIG. 1, serves two purposes. Initially, all of the players' markers are placed on the START portion of the square. As the pieces advance and move around the board, if a marker lands on this square during play, the marker is placed on the MISH MASH portion of the square.

As shown, the squares are located along the periphery of the game board. However any number of alternative placements of the squares is possible.

In this embodiment, the game utilizes three subject categories: History, Presidents and Mish Mash which is a miscellaneous category. However, it is clearly within the scope of the invention, to have subject categories encompassing a wide variety of topics and to have subject specific embodiments that address specific topics such as entertainment, sports, current events, science, the arts and the like. In the center of the game board are shown three rectangles where the subject cards are placed during the game. Each category of subject cards are distinctly colored to aid identification. The cards are kept face down on the rectangle corresponding to the subject category of the cards. The person sitting to the right of the current player will handle the presentation of the question. The presenter will pick up the subject card corresponding to the subject of the square on which the current player has landed. The presenter will read the question, determine if the current player has given a correct answer in the allotted time. If a correct answer is given, then the presenter begins timing a 60 second period during which the current player must construct a list of words comprised of the letters that make up the correct answer. Blank paper and pencil are provided for the current player to use to create this written list of words. No letter may be used more than the number of times that the letter appears in the answer. The presenter will call a 10 second warning before the end of the 60 second period. At the end of 60-sec period, the presenter will evaluate the word list and credit the current player with 10 points for a correct answer and a variable number of points for each validated word in the constructed word list. Generally all players, at the start of the game, shall agree to use some common reference book as the authoritative source of validating words. For example, they might chose a standard dictionary that is available. Each validated word shall receive a point value equal to the number of letters in the validated word. Thus a three letter word would receive 3 points and a four letter word would receive four point and so on. Total points are tallied and added to any points that the player has earned during previous rounds of play. Play then passes to the left. The previous current player will then function as the question presenter for the new current player.

Such administrative matters, which are handled by one of the players in the above described embodiment could be handled by a single person acting full time as a question presenter or Master of Ceremonies. Such would be the case if the game were broadcast on television as a game show. Further, if the game were incorporated into a computer program, the program itself would handle such tasks as presenting the question, validating correct answers, validating the constructed word list and tallying total points.

Minor variations in such items as the number of players, the number of subject categories, time allotted to answer the question, time allotted to prepare the word list, specifics as to points allocated per each correct word and total number of points needed to the winner, can be made without departing from the scope and spirit of the invention.

Although preferred embodiments of the invention have been described in the foregoing description and illustrated in the accompanying drawings, it will be understood that the invention is not limited to the embodiments disclosed but is capable of numerous rearrangements, modifications and substitutions of parts and elements and rules without departing from the spirit the invention. Accordingly, the present invention is intended to encompass such rearrangements, modifications of parts, elements and rules as within the spirit and scope of this invention.

I claim:

1. A method of playing a game comprising the steps of:

providing a game board having a plurality of playing spaces defined thereon, said playing spaces defining a playing path; said playing spaces containing therein indica of one of one or more subject categories, said game board further having a starting playing space located on said playing path;

providing one or more card spaces, wherein the number of said card spaces are at least equal to the number to said subject categories;

providing a plurality of question cards containing thereon a question and an answer to said question, said plurality of cards comprised of at least one card containing a question and answer pertaining to each of said subject categories placing said plurality of question cards in stacks upon said card spaces so that all question cards pertaining to each of said plurality of subject categories is placed upon said corresponding card space, said stacks having a topmost card, providing a plurality of playing pieces, each of said playing pieces being used to represent one of a plurality of players, said playing pieces being positioned on the starting playing space at the start of the game;

providing a means for randomly generating a number, wherein each player in turn generates a random number, advances his playing piece along the playing path the same number playing spaces as the random number;

presenting to the player the question on the topmost card in said stack of question cards which corresponds to subject category on the playing space occupied by the player's piece;

the player answers the question, and if the answer is correct, constructs a word list based upon the letters in the correct answer, evaluating said word list and awarding points to the player based upon the number and nature of the words constructed wherein the first player to receive a predetermined number of points is declared the winner of the game.

2. A method of playing a word game comprising the steps of:

a. providing a plurality of questions and corresponding answers relating to one or more subject categories;

b. providing a means of randomly selecting one of said of subject categories;

c. selecting a random subject category and then selecting a random question corresponding to said selected subject category and presenting said selected question to a player and evaluating the answer given by said player;

d. wherein if said answer is correct, the player giving the correct answer is allowed to create a list, within a specified period of time, of as many words as possible from the letters that make up the correct answer, evaluating the list and generating a score based upon said evaluation and adding said score to any previously earned score that player may have accumulated; and e. repeating steps c and d with each play in turn being presented the question until one player has accumulated a predetermined score.

3. The method of playing a game as set forth in claim 2 wherein said means of randomly selecting described in step b is throwing one or more dies.

4. The method of playing a game as set forth in claim 3 wherein said step of evaluating a list comprises the steps of:

establishing a standard word reference source;

comparing said each word in said word list to see if each word in said list is found with in said standard word reference source.

5. The method of playing a game as set forth in claim 4 wherein said standard word reference is a dictionary.

* * * * *